US007013509B2

(12) United States Patent
Hickman

(10) Patent No.: US 7,013,509 B2
(45) Date of Patent: Mar. 21, 2006

(54) EASY ON/EASY OFF PILLOW AND BLANKET COVER

(76) Inventor: Robert J. Hickman, 1201 Richmond La., Wilmette, IL (US) 60091

( * ) Notice: Subject to any disclaimer, the term of this patent is extended or adjusted under 35 U.S.C. 154(b) by 0 days.

(21) Appl. No.: 10/810,110

(22) Filed: Mar. 26, 2004

(65) Prior Publication Data

US 2004/0187210 A1 Sep. 30, 2004

Related U.S. Application Data

(60) Provisional application No. 60/458,527, filed on Mar. 28, 2003.

(51) Int. Cl.
*A47G 9/02* (2006.01)

(52) U.S. Cl. ..... 5/485; 5/490

(58) Field of Classification Search ..... 5/482, 5/485, 486, 502, 488, 489, 490, 491, 501
See application file for complete search history.

(56) References Cited

U.S. PATENT DOCUMENTS

| | | | | | |
|---|---|---|---|---|---|
| 830,970 | A | * | 9/1906 | Cary | 5/491 |
| 1,261,314 | A | * | 4/1918 | Stoddard | 5/501 |
| 2,637,860 | A | * | 5/1953 | Lehigh | 5/502 |
| 2,736,043 | A | * | 2/1956 | Temple | 5/502 |
| 2,759,200 | A | * | 8/1956 | Johnston | 5/490 |
| 3,241,161 | A | * | 3/1966 | Dashosh | 5/501 |
| 4,480,346 | A | | 11/1984 | Hawkins et al. | |
| 4,480,347 | A | | 11/1984 | Hawkins et al. | |
| 4,631,765 | A | * | 12/1986 | Casey | 5/417 |
| 4,903,361 | A | * | 2/1990 | Tang | 5/502 |
| 5,157,799 | A | * | 10/1992 | Aird | 5/490 |
| 5,279,009 | A | * | 1/1994 | Putka, Jr. | 5/485 |
| 5,566,410 | A | | 10/1996 | Schaechter | |
| 6,032,308 | A | * | 3/2000 | Chuang | 5/502 |
| 6,073,283 | A | * | 6/2000 | Zheng | 5/417 |
| 6,088,852 | A | | 7/2000 | Quandt | |
| 6,363,553 | B1 | * | 4/2002 | Baumgartel et al. | 5/482 |
| 6,427,268 | B1 | | 8/2002 | Davis | |

* cited by examiner

*Primary Examiner*—Michael Safavi
(74) *Attorney, Agent, or Firm*—Meroni & Meroni, P.C.; Charles F. Meroni, Jr.

(57) ABSTRACT

A bedding cover having a hidden multisided access flap for improved access to a pocket of the bedding cover generally comprising a front panel stitched to a back panel providing a pocket between the front panel and the back panel. A multisided access flap within the back panel provides access to the pocket. A first fastener securing a first side of the access flap is substantially covered by a first hiding flap provided by an edge of the back panel opposing the first side of the access flap. A second fastener positioned substantially perpendicular to the first fastener secures a second side of the access flap and provides multidirectional access to the pocket. A second hiding flap substantially provided by a second edge of the back panel opposing the second side of the access flap covers the second fastener.

6 Claims, 3 Drawing Sheets

EASY ON/EASY OFF PILLOW AND BLANKET COVER

PRIOR HISTORY

This application claims the benefit of U.S. Provisional Application No. 60/458,527 filed Mar. 28, 2003.

BACKGROUND OF THE INVENTION

1. Field of the Invention

The claimed invention generally relates to ornamental and protective covers for bedding. More specifically, the claimed invention relates to an improved cover having structure providing easy insertion and removal for bedding such as pillows and blankets.

2. Background

It is common place practice to place protective or decorative covers such as pillow shams and duvet covers over bedding articles such as pillows or blankets by creating a pocket between two pieces of material having an opening along one seam for placing a bedding article within the pocket. Covers of this type are often hard to put into place due to difficulties associated with placing an easily deformable item such as a pillow or blanket within a cover made of pliable material. Further, the opening providing access to the pocket is typically either left open or secured with a fastener such as an eyelet and button arrangement resulting in an unpleasant appearance.

U.S. Pat. No. 5,566,410 issued to Schaechter is an example of the prior art relating to bedding covers. Schaechter discloses a quick sealing pillow cover having a hook and loop closure on the inside flaps of the opening along one seam of the pillow cover. Pillow covers of this type, as previously mentioned, are difficult to put into place and present unsightly closure seams.

U.S. Pat. No. 6,427,268 issued to Davis is another example of the prior art relating to bedding covers. Davis discloses a unitary pillow sham for covering a plurality of pillows in individual pockets within one collective unit. The pillows within the pockets of the sham are held in place by overlapping lips within the back face of the pillow sham. Pillow shams of this type of construction provide only one aesthetically presentable side due to the unsightly access opening across the middle of one side of the sham.

In order to address the problem of providing a decorative and protective bedding cover that is both easy to put into place and aesthetically pleasing from all sides, the present invention provides an. The Easy On/Easy Off Pillow and Blanket Cover as here disclosed differs from the previously used pillow and bedding covers and employs a number of novel features and improvements that render it highly advantageous over the aforementioned prior art, as such improvements are hereafter described in further detail.

SUMMARY OF THE INVENTION

It is a primary object of the claimed invention to provide a pillow sham or duvet cover with improved access to the pocket within the cover.

It is another object of the claimed invention to provide a pillow sham or duvet cover that has an aesthetically pleasing appearance from all sides.

It is a further object of the claimed invention to provide making a pillow sham or duvet cover with improved access to the pocket within the cover while having an aesthetically pleasing appearance from all sides.

The claimed invention provides a bedding cover such as a pillow sham or duvet cover that provides improved access to the pocket within the cover as well an aesthetically pleasing appearance from all sides. A pillow sham or duvet cover embodying the claimed invention generally comprises a front panel and a back panel having an access flap with a vertical hidden zipper and a horizontal hidden zipper for securing bedding such as a pillow or blanket within the pocket of the pillow sham or duvet cover.

The back panel having an access flap capable of being opened along two perpendicular seams of the cover provides improved access. A cover of this type can be placed on a flat surface such as a bed or table with the access flap facing up. The access flap can be opened along the two perpendicular seams allowing the access flap to be folded back so that a bedding item such as a pillow or blanket can be placed properly within the pocket of the cover. After the bedding item is placed in the pocket, the access flap can be secured shut with hidden zippers. Providing a cover that allows a portion of the cover to be folded away during placement of a bedding item within the pocket of the cover eliminates problems in the prior art associated with having a single seam opening, such as having to shake the bedding item into place within the pocket.

The hidden zippers are generally oriented adjacent a break line or hem line in the cover such that the hidden zippers are not readily noticeable, lending to the overall aesthetic appearance of the cover. A flap that is created by a hemmed portion of the back panel hides the zippers from view and provides a side of the cover that can be readily displayed without sacrificing the aesthetic appearance of the cover.

DETAILED DESCRIPTION OF THE PREFERRED EMBODIMENT

Figure 1:
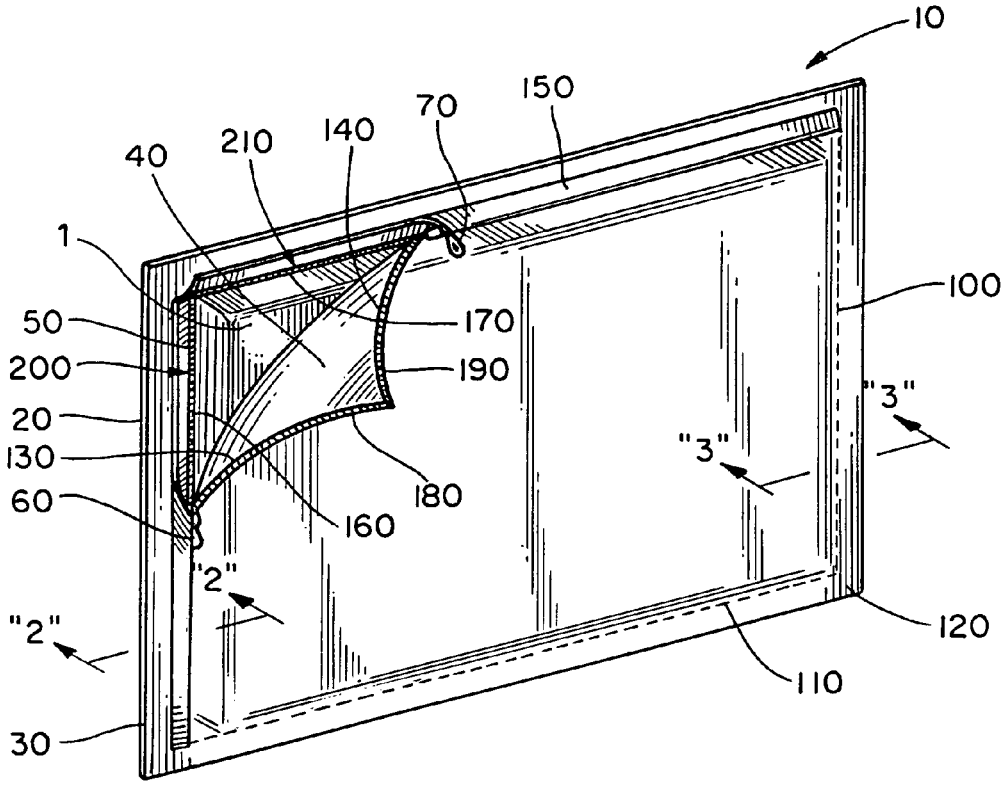
FIG. 1. A perspective view of a pillow inside a pillow cover of the claimed invention.

Turning now to the drawings, FIG. 1 shows a perspective view of a pillow 1 placed within a tailored sham 10 embodiment of the pillow cover. The tailored sham 10 generally comprises a front panel 20 and a back panel 30 having an access flap 40 that creates a pocket 50 for receiving the pillow 1. The access flap 40 is securable by a hidden vertical zipper 60 and a hidden horizontal zipper 70. Preferably, the tailored sham 10 is sized and shaped to receive rectangular pillows of various standard sizes. However, it is contemplated as being within the scope of the claimed invention that pillow covers and blanket covers of other shapes, sizes, and styles may be made following the teachings of the claimed invention.

Figure 2:
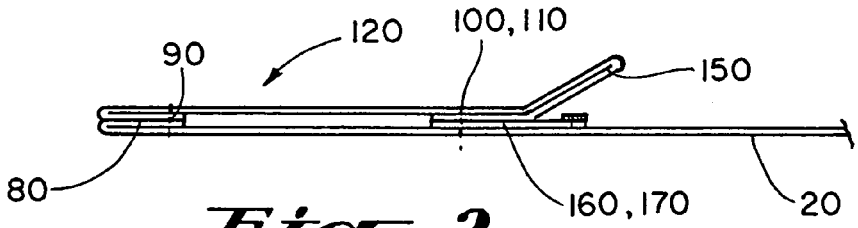
FIG. 2. A cross sectional view of the zippered portions of the pillow cover pocket.
Figure 3:
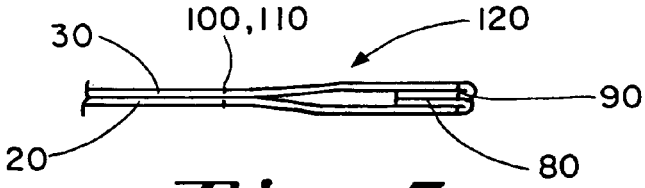
FIG. 3. A cross sectional view of the stitched portions of the pillow cover pocket.

The front panel 20 and back panel 30 shown in FIGS. 1–3 are rectangular shaped pieces of fabric material having hem portions 80 about the periphery of each of the panels 20, 30. The back panel 30 is sized slightly larger than the front panel 20 so that the access flap 40 and hidden zippers 60, 70 may be sewn into the back panel 30 while still maintaining a proper size relationship with the front panel 20. The hem portions 80 are sewn together by a first stitching 90 about the periphery of the panels 20, 30. Vertical stitching 100 at each end of the sham 10 and horizontal stitching 110 at each side of the sham 10 creates the tailored flange 120 and defines the size and shape of the pocket 50 for receiving the pillow 1. In other embodiments of the invention, such as a ruffled pillow sham (not shown), a ruffled edge may be sewn between the front panel 20 and back panel 30 in place of the tailored flange 120.

The multisided access flap 40 within the back panel 30 is generally sized so that the access flap 40 lies within the vertical stitching 100 and horizontal stitching 110 to allow access to the pocket 50 surrounded by the tailored flange 120. The access flap 40 is shaped to have a first side vertical edge 130 parallel to the vertical stitching 100 and a second side horizontal edge 140 parallel to the horizontal stitching 110 that are securable by zippers 60, 70 beneath the fastener hiding flaps 150.

The fasteners shown in FIGS. 1 and 2 are illustrated as being zipper type fasteners. However, it is contemplated that various types of fasteners such as eyelet and button arrangements or hook and loop fastener systems may be used to secure the access flap. The vertical and horizontal zippers 60, 70 shown have first portion stationary tapes 160, 170 with teeth secured between the front panel 20 and the back panel 30 by the vertical and horizontal stitching 100, 110 and second portion movable tapes 180, 190 with teeth stitched to the vertical and horizontal edges 130, 140 of the access flap 40.

The fastener hiding flaps 150 are created from the back panel 30 by hemming the opposing edges 200, 210 of the access flap 40 with the vertical and horizontal stitching 100, 110 holding the stationary tapes 160, 170 and forming the tailored flange 120.

Figure 6:
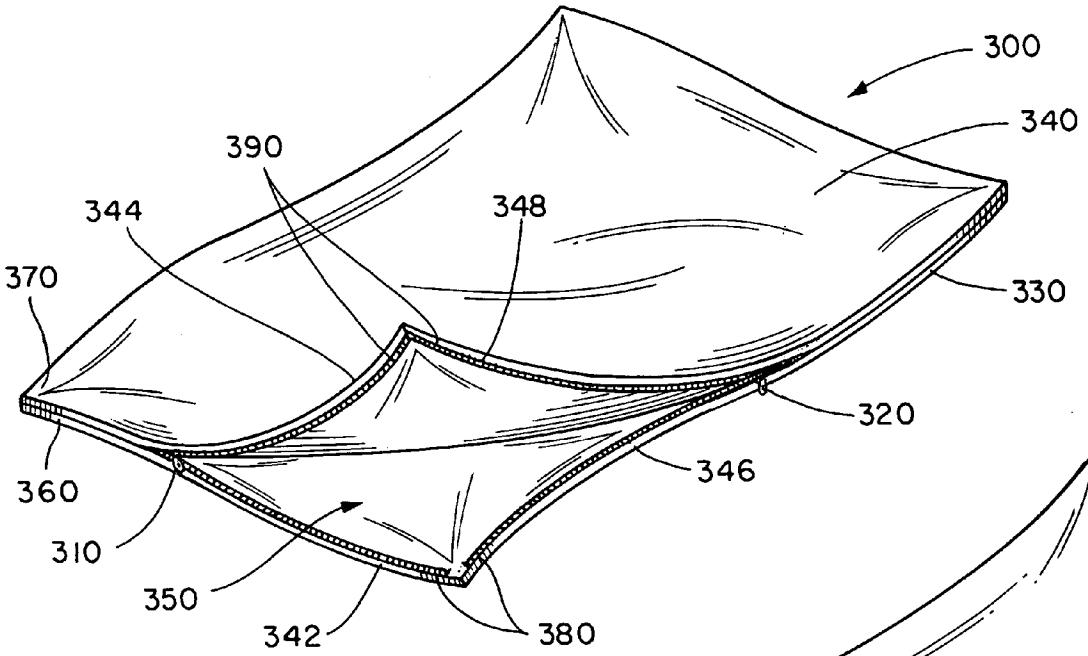
FIG. 6. A perspective view of another embodiment of the claimed invention where the back panel is partially unzipped from the front panel.
Figure 7:
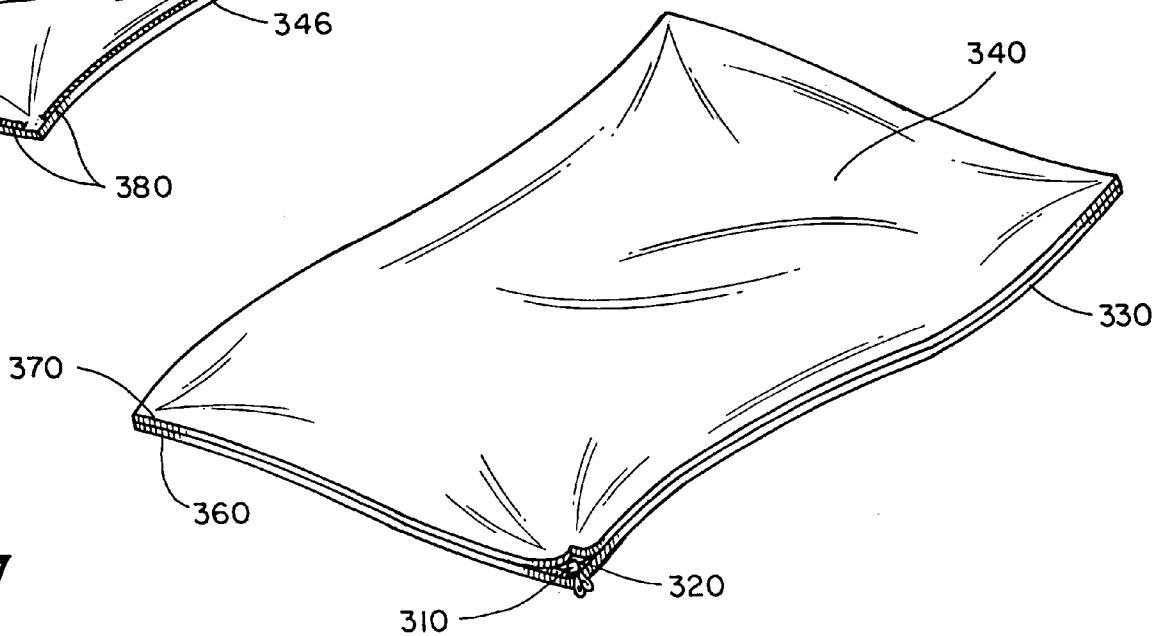
FIG. 7. Another perspective view of the embodiment shown in FIG. 4 where the pocket of the bedding cover is zipped closed.

Another embodiment of the bedding cover 300 is shown in FIGS. 6 and 7 where the fasteners 310, 320 are oriented along the perimeter edges of the back panel 330 and front panel 340 providing a first open edge of the pocket 342, a second open edge of the pocket 344, a third open edge of the pocket 346 and a fourth open edge of the pocket 348. FIG. 7 shows a pair of zipper type fasteners 310, 320 being utilized to close the pocket 350 between the front panel 340 and back panel 330. The hemmed edges 360, 370 of the front panel 340 and back panel 330 are stitched adjacent the stationary 380 and movable 390 tapes of the zippers 310, 320 as shown in FIG. 2 so that the zippers 310, 320 are hidden when in a zipped position.

Figure 4:
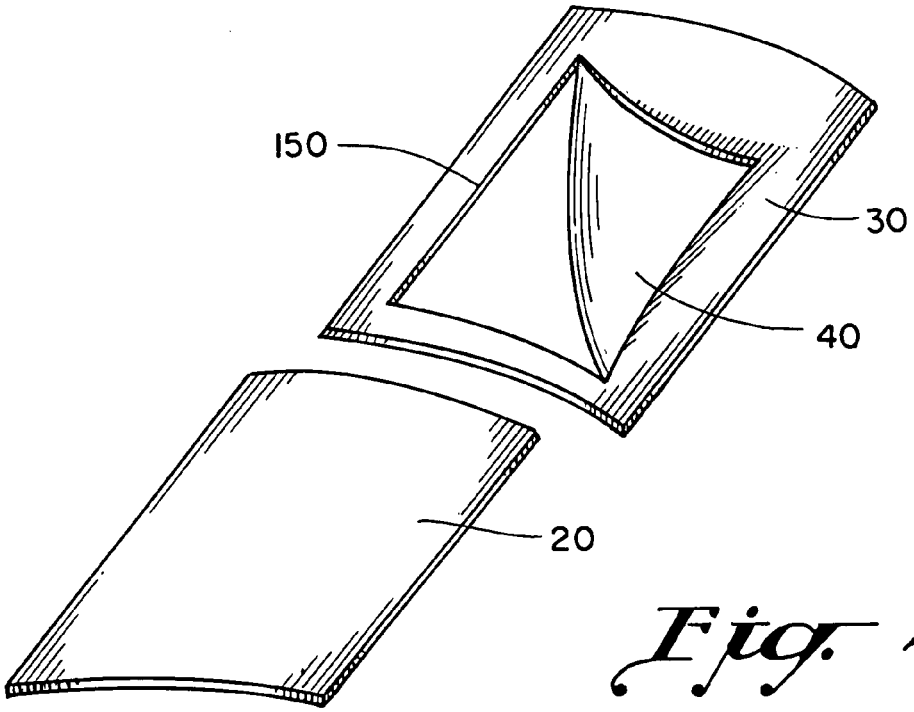
FIG. 4. A perspective view of the front panel and back panel before assembly.
Figure 5:
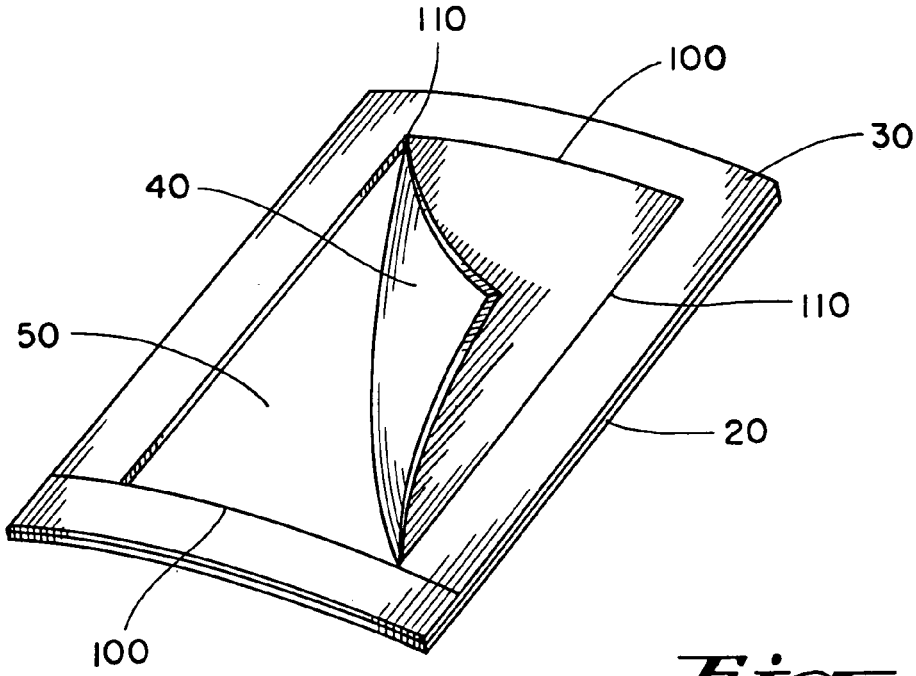
FIG. 5. A perspective view of the bedding cover after assembly of the front panel and back panel.

The pillow sham or duvet cover 10 as shown in FIGS. 4 and 5 is provided with an improved access to the pocket 50 within the cover 10 while having an aesthetically pleasing appearance from all sides. This pillow sham can be made by cutting a front panel 20 of a particular desired size and shape to cover a bedding article 1. A back panel 30 is cut larger than the front panel 20 to provide a pocket 50 for the bedding article 1 between the front panel 20 and back panel 30. A multisided access flap 40 is cut within the back panel 30 to provide access to the pocket 50 as shown in FIG. 4. The cutting of the access flap 40 makes a corresponding hiding flap 150 adjacent the access flap 40.

After the front panel 20 and back panel 30 have been cut, the perimeter edges of the front panel 20 and perimeter edges of the back panel 30 are hemmed while simultaneously stitching the front panel 20 and back panel 30 together to provide the pocket 50 as shown in FIGS. 2 and 3. The fastener 60, 70 is then stitched into the cover 10 for closing the access panel 40 after the bedding article 1 has been placed in the pocket 50. The stationary fastener stitching 100 also defines a portion of the pocket 50 and the flange 120 adjacent the pocket 50. Another stitching 110 simultaneously defines another portion of the pocket 50 and another portion of the flange 120 as shown in FIG. 5.

Although the invention has been described by reference to some embodiments it is not intended that the novel device be limited thereby, but that modifications thereof are intended to be included as falling within the broad scope and spirit of the foregoing disclosure and the appended drawings.

I claim:

1. A bedding cover having a hidden multisided access flap for improved access to a pocket of the bedding cover, the bedding cover comprising:

a front panel;

a back panel sized larger than the front panel connected to the front panel providing a pocket between the front panel and the back panel;

a multisided access flap within the back panel providing access to the pocket;

a first fastener for securing a first side of the flap, a first portion of the first fastener held by the connection between the front panel and back panel, a second portion of the first fastener connected to the first side of the access flap;

a first hiding flap substantially covering the first fastener provided by an edge of the back panel opposing the first side of the access flap;

a second fastener for securing a second side of the flap, a first portion of the second fastener held by the connection between the front panel and back panel, a second portion of the second fastener connected to the second side of the access flap; and a second hiding flap substantially covering the second fastener provided by a second edge of the back panel opposing the second side of the access flap.

2. The bedding cover of claim 1 further comprising a stitching connecting the front panel and back panel defining the pocket and providing a flange about the pocket.

3. The bedding cover of claim 1 wherein the first fastener is positioned substantially perpendicular to the second fastener providing multidirectional access to the pocket.

4. The bedding cover of claim 3 further comprising a stitching connecting a peripheral edge of the front panel to a peripheral edge of the back panel.

5. The bedding cover of claim 4 wherein the peripheral edge of the front panel is defined by a first hem portion and the peripheral edge of the back panel is defined by a second hem portion, the first and second hem portion secured by the stitching.

6. The bedding cover of claim 5 wherein the first fastener and second fastener are zippers.

* * * * *